United States Patent [19]

Jeschke et al.

[11] Patent Number: 4,606,269

[45] Date of Patent: Aug. 19, 1986

[54] REGISTER ADJUSTMENT DEVICE FOR A ROTARY PRINTING MACHINE

[75] Inventors: Willi Jeschke, Heidelberg; Anton Rodi, Leimen, both of Fed. Rep. of Germany

[73] Assignee: Heidelberger Druckmaschinen AG, Heidelberg, Fed. Rep. of Germany

[21] Appl. No.: 711,988

[22] Filed: Mar. 14, 1985

[30] Foreign Application Priority Data

Mar. 14, 1984 [DE] Fed. Rep. of Germany ..... 3409194

[51] Int. Cl.[4] ..... B41F 13/14; B41L 35/06

[52] U.S. Cl. ..... 101/248

[58] Field of Search ..... 101/248, 181, 177, 217, 101/218, 137, 142

[56] References Cited

U.S. PATENT DOCUMENTS 2,002,584 5/1935 Rawson ..... 101/248
2,660,115 11/1953 Ras ..... 101/248
3,717,092 2/1973 Crum ..... 101/248

FOREIGN PATENT DOCUMENTS 2921153 12/1980 Fed. Rep. of Germany ..... 101/248

*Primary Examiner*—J. Reed Fisher
*Attorney, Agent, or Firm*—Herbert L. Lerner; Laurence A. Greenberg

[57] ABSTRACT

In a rotary printing machine, a register adjustment device for adjusting circumferential register and lateral register of a plate cylinder mounted for displacement in axial direction thereof and being connected to a device for displacing the plate cylinder in axial direction includes a double gear having first and second toothings thereon, one of the toothings having obliquely extending teeth and the other of the toothings having teeth extending in a direction differing from the direction in which the teeth of the one toothing extend, both the first and the second toothings being immovable relative to one another, the double gear being also mounted for displacement in axial direction thereof and being connected to a device for displacing the double gear; a drive gear meshing with the first toothing; and a further gear meshing with the second toothing, the further gear being connected with the plate cylinder and fixed thereto against relative rotation therewith and against relative displacement in axial direction thereof, the other toothing being formed of straight teeth.

6 Claims, 2 Drawing Figures

REGISTER ADJUSTMENT DEVICE FOR A ROTARY PRINTING MACHINE

Figure 1:
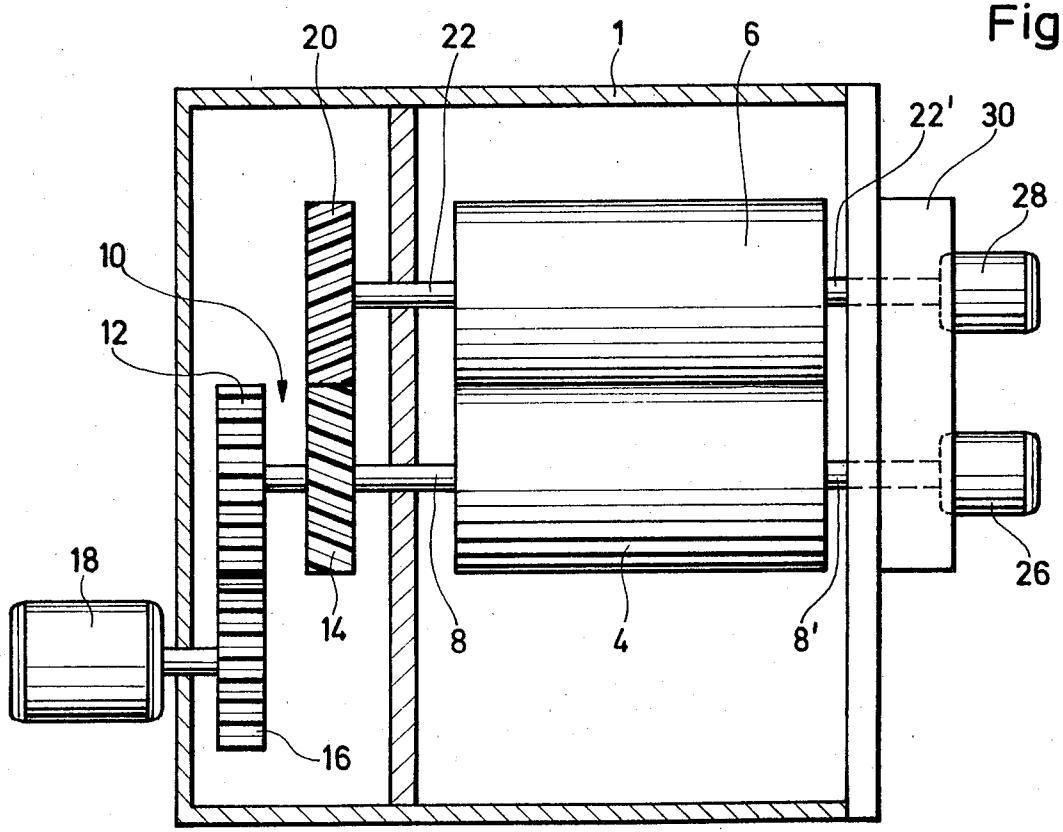

The invention relates to a register adjustment device for a rotary printing machine for adjusting circumferential register and lateral register of a plate cylinder, including a drive gear meshing with a first toothing of a double gear, a second toothing of which meshes with a further gear connected with the plate cylinder and fixed thereto against relative motion therewith and against relative displacement in axial direction thereof. One of the toothings on the double gear having oblique or helical teeth, and the other of the toothings on the double gear teeth extending in a different direction than that in which the oblique teeth extend, both teeth on the double gear being immovable relative to one another. The double gear is axially movable and connected with a first adjustment device, and the plate cylinder is axially movable and connected with a second adjustment device.

Such a device has become known heretofore from German Published Non-Prosecuted application (DE-OS) No. 29 21 153. The double gear possessing two oblique or helical gears with opposite slope or inclination is connected, on the one hand, with a drive gear and, on the other hand, drives the plate cylinder. The double gear itself is connected with the rubber cylinder of the printing machine which is constructed as an offset printer. If only the lateral register is to be adjusted, the double gear together with the rubber cylinder is shifted in axial direction thereof. If only the circumferential register is to be adjusted, the gear connected with the plate cylinder is shifted together with the cylinder in direction of the longitudinal axis thereof, and a shift of the double gear in the axis thereof simultaneously is necessary in order to compensate for the consequent adjustment in circumferential direction. Similarly, in the case of the device known heretofore from German Patent (DE-PS) No. 21 57 278, the circumferential register adjustment must be actuated simultaneously with the adjustment of the lateral register. This is effected, in fact, by shifting the double gear exactly half the travel by which the plate cylinder with the further gear is shifted. This heretofore known register adjustment device is thereby quite costly.

It is accordingly an object of the invention to provide a device of the afore-described general type in which, insofar as common actuation of the two adjustment devices is necessary to achieve adjustment only of one register, this common adjustment can be achieved in the same way.

With the foregoing and other objects in view there is provided, in accordance with the invention, in a rotary printing machine, a register adjustment device for adjusting circumferential register and lateral register of a plate cylinder mounted for displacement in axial direction thereof and being connected to a device for displacing the plate cylinder in axial direction, comprises a double gear having first and second toothings thereon, one of the toothings having obliquely extending teeth and the other of the toothings having teeth extending in a direction differing from the direction in which the teeth of the one toothing extend, both the first and the second toothings being immovable relative to one another, the double gear being also mounted for displacement in axial direction thereof and being connected to a device for displacing the double gear; a drive gear meshing with the first toothing: and a further gear meshing with the second toothing, the further gear being connected with the plate cylinder and fixed thereto against relative rotation therewith and against relative displacement in axial direction thereof, the other toothing being formed of straight teeth.

The invention can be realized in several different embodiments of which, in one embodiment, the other toothing of the double gear is in meshing engagement with the drive gear which is thus also straight-toothed. This provides the advantage for an offset printing machine that the rubber or blanket cylinder is not adjusted in circumferential direction. If the rubber cylinder together with the double gear fastened thereto is shifted in axial direction thereof, the circumferential register of the plate cylinder is changed. In order to achieve a lateral register adjustment of the plate register without circumferential register adjustment, the double gear and the further gear are shifted together the same distance in axial direction thereof. This results in a mackling-free lateral register adjustment during the printing.

In another embodiment of the invention, the other toothing of the double gear is straight-toothed and is in meshing engagement with the further gear, which is connected to the plate cylinder and which in this case is consequently straight-toothed. By shifting the double gear in axial direction thereof, only a circumferential adjustment of the plate cylinder results. A further advantage is that only the plate cylinder must be shifted in axial direction thereof in order to adjust the lateral register of the plate cylinder. In the latter embodiment of the invention, actuation of a single adjustment device is necessary if only either the lateral register or the circumferential register is to be changed.

The latter embodiment of the invention has a further advantage in that a mackling-free circumferential register adjustment is possible during printing, and the drive is per se obliquely toothed, which is frequently viewed as being an advantage.

The double gear must not necessarily be connected with a cylinder of the printing machine, but it is connected in a preferred embodiment with the rubber cylinder of a printing machine constructed as an offset printing machine.

In accordance with additional features of the invention, the plate cylinder is disposed in mutually parallel engagement with a blanket cylinder, all of the gears being located at one end of the cylinders, and electric motors being located at the other end of the cylinders and connected to respective shafts of the cylinders via threaded spindles supported in ball bearings and extending through threaded bores formed in a bridge, the electric motors being controllable for adjusting the circumferential and the lateral register of the cylinders separately from one another or simultaneously.

The advantage of this type of construction is that independent adjustment of the circumferential and lateral register is possible without additional mechanics, and thus without bearing play which involves additional mechanics.

The drive gear need not be connected directly with a drive motor. In a printer with several printing units, one drive motor is generally provided for more than one printing unit. This motor can then indeed be directly connected with the drive gear of a single one of the printing units, but the drive gears for the other printing units are mechanically coupled with the drive gear connected with the motor. In accordance with a concomitant feature of the invention, the plate cylinder is disposed in mutual parallel engagement with a blanket cylinder, both of the cylinders being mounted on respective parallel shafts, the further gear being fastened to the shaft of the plate cylinder and the double gear being fastened to the shaft of the blanket cylinder, and the drive gear being fastened to a shaft whereon an impression cylinder of the printing machine is mounted. The impression cylinder presses the paper to be printed against the rubber or blanket cylinder.

Other features which are considered as characteristic for the invention are set forth in the appended claims.

Although the invention is illustrated and described herein as embodied in a register adjustment device for a rotary printing machine, it is nevertheless not intended to be limited to the details shown, since various modifications and structural changes may be made therein without departing from the spirit of the invention and within the scope and range of equivalents of the claims.

Figure 2:
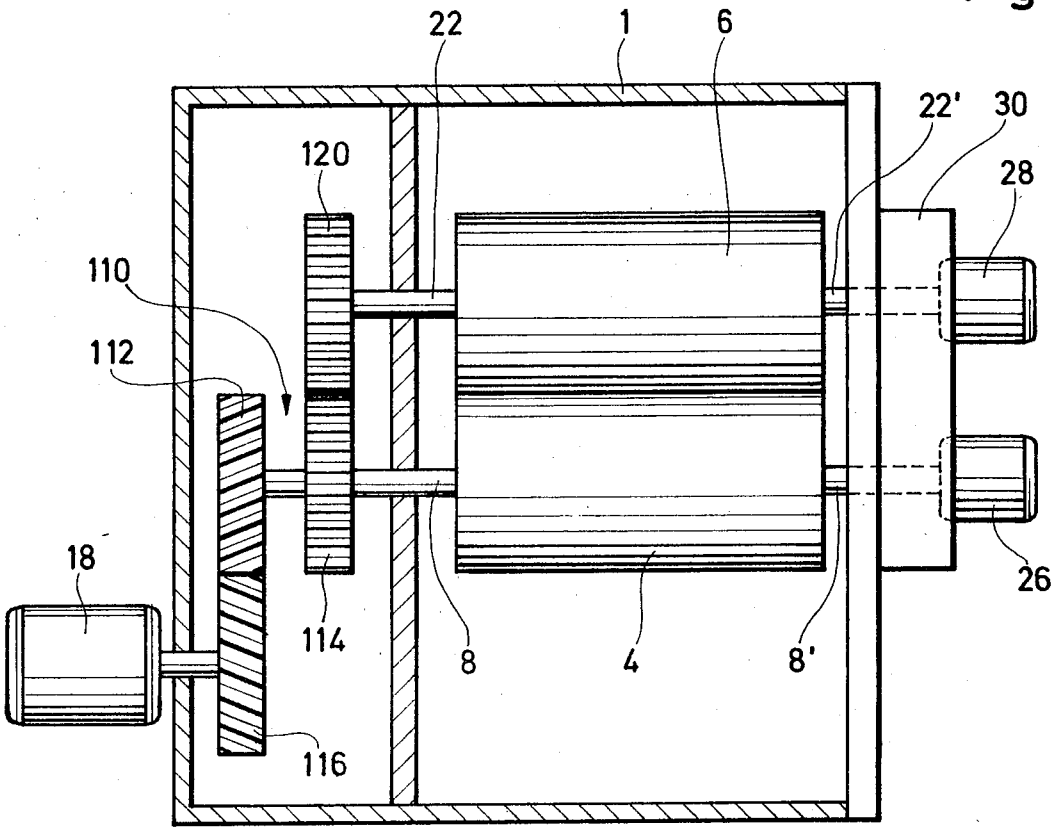

The construction and method of operation of the invention, however, together with additional objects and advantages thereof will be best understood from the following description of specific embodiments when read in connection with the accompanying drawings, in which:

FIG. 1 is a front elevational view, partly in section of a printing unit of an offset printing machine incorporating the register adjustment device according to the invention: and FIG. 2 is a view similar to that of FIG. 1 showing another embodiment of the invention.

It is believed to be obvious that the invention, in general, is used in printing machines having several printing units or inking units. To explain the invention, it is necessary, however, only to represent a single printing unit. Those details which are not directly necessary to understand the invention are not illustrated in the figures of the drawing.

Referring now to the drawing and first, more particularly, to FIG. 1 thereof, there are shown a rubber or blanket cylinder 4 and a plate cylinder 6 which are rotatably mounted in a machine frame 1. Conventional devices for feeding printing ink and water to the plate cylinder 6 have not been illustrated in the interest of clarity. A double gear 10 is connected via a shaft 8 to a blanket cylinder 4 which prints the paper to be printed. The double gear 10 and the blanket cylinder 4 are fixed to one another against relative rotation and are immovable with respect to one another in axial direction. The double gear 10 is formed with two gearings or gear-tooth systems, which are likewise fixed against relative rotation and axially immovable relative to one another, and are represented in FIG. 1 by individual gears. In fact, a first gearing 12 is provided which is formed of a straight-toothed gear, and a second gearing 14 is formed of a helical or oblique gear. The first gearing 12 meshes with a straight-toothed drive gear 16 which is connected with a shaft of an electric motor 18 serving as a drive.

In FIG. 1, the electric motor 18 is directly connected to the drive gear 16. It is noted, however, that this is generally not the case for all printing units of a printing machine having a plurality of printing units, and it is also possible with such a printing machine, to connect the shaft of the electric motor 18 to any desired gear of the drive train. In FIG. 1, the drive gear 16 is not connected to any other cylinder of the printing machine. It is also possible, however, to form the drive gear 16 as a drive wheel of an otherwise non-illustrated impression cylinder which presses the paper against the blanket cylinder 4.

The second toothing 14 meshes with a likewise obliquely or helically toothed gear 20, which is connected via a shaft 22 with the plate cylinder 6, fixed against relative rotation and immovable in axial direction.

Displacement or adjustment devices are arranged at the side of the cylinder 4 and 6 facing away from the gears. And, indeed, an electric motor 26 is provided which, depending upon the direction of operation thereof, shifts the blanket cylinder 4 with the double gear 10 in one or the other direction axially parallel to the shaft 8, and an electric motor 28, depending upon the direction of rotation thereof, shifts the plate cylinder 6 with the gear 20 fastened thereto likewise axially parallel in one or the other direction. In these displacement or shifting devices, a threaded spindle is connected to the shaft of the motor 26 and 28, respectively, and cooperates with counterparts formed by threaded bores in a bridge 30, and the end of the shafts for these motors 26 and 28, which faces away from the respective motor 26 or 28, is connected by means of ball bearings to withstand tension with respect to the ends 8′ and 22′ of the respective shafts 8 and 22 adjacent to the displacement or adjustment device. The bridge 30, which also carries the motors 26 and 28, is firmly connected to the machine frame 1.

If only the circumferential register of the plate cylinder 6 is to be changed i.e. the rotational position or setting of the plate cylinder 6 is to be changed while the drive gear 16 is stationary, the blanket cylinder 4 together with the double gear 10 is then shifted in longitudinal direction by the electric motor 26. The rotational setting of the double gear 10 does not thereby change because, when the drive gear 26 is stationary, the rotational setting of the first gearing 12, which has straight teeth, also does not change. In contrast therewith, due to the longitudinal shift of the second inclined or helical toothing 14, the rotational setting of the gear 20, which is connected to the plate cylinder, is changed.

If only the lateral register of the plate cylinder 6 is to be changed i.e. the plate cylinder 6 is to be shifted in longitudinal direction of the shaft 22 thereof, without changing the rotational setting thereof (while the drive gear 16 is stationary), the blanket cylinder 4 and the plate cylinder 6 are shifted like distances by the respective electric motors 26 and 28. A relative displacement or shift in longitudinal direction between the shafts 8 or 22 does not then occur between the second toothing 14 and the gear 20, and the relative shift between the first toothing 12 and the drive gear 16 effects no turning of the cylinders.

In FIG. 2 illustrating another embodiment of the invention, it is apparent that only the individual gears are different from those in the embodiment of FIG. 1. The double gear identified by the reference numeral 110 in FIG. 2, which for its part is connected to the blanket cylinder 4, again has an oblique or helical toothing and a straight toothing. In this embodiment in FIG. 2, however, the first toothing 112 is obliquely or helically toothed and, correspondingly, the drive gear 116 is obliquely or helically toothed. The second toothing 114 is straight-toothed, on the other hand, and the gear 120 connected to the plate cylinder 6 is also accordingly straight-toothed.

If the lateral register of the plate cylinder 6 in the embodiment of FIG. 2 is to be changed, only the plate cylinder 6 is shifted in longitudinal direction thereof by the electric motor 28. Because the second toothing 114 and the gear 120 are straight-toothed, the rotational direction of the plate cylinder 6 does not thereby change. If only the circumferential register of the plate cylinder 6 is to be changed, only the blanket cylinder 4 with the double gear 110 of the FIG. 2 embodiment need be shifted. Due to the meshing of the first toothing 112 with the obliquely or helically toothed drive gear 116, the rotational setting of the double gear 110 changes relative to the drive gear 116, and the change of the rotational setting is transmitted to the plate cylinder 6 by the meshing of the second toothing 114 with the gear 120.

We claim:

1. In a rotary printing machine, a register adjustment device for adjusting circumferential register and lateral register of a plate cylinder mounted for displacement in axial direction thereof and being connected to a device for displacing the plate cylinder in axial direction, comprising a double gear having first and second toothings thereon, one of said toothings having obliquely extending teeth and the other of said toothings having teeth extending in a direction differing from the direction in whch the teeth of said one toothing extend, both said first and said second toothings being immovable relative to one another, said double gear being also mounted for displacement in axial direction thereof and being connected to a device for displacing said double gear; a drive gear meshing with said first toothing; and a further gear meshing with said second toothing, said further gear being connected with the plate cylinder and fixed thereto against relative rotation therewith and against relative displacement in axial direction thereof, said other toothing being formed of straight teeth extending parallel to the axis of said double gear.

2. Register adjustment device according to claim 1, wherein said other toothing of said double gear is in meshing engagement with said drive gear.

3. Register adjustment device according to claim 1, wherein said other toothing of said double gear is in meshing engagement with said further gear connected with the plate cylinder.

4. Register adjustment device according to claim 1, wherein the plate cylinder is disposed in mutually parallel engagement with a blanket cylinder, all of said gears being located at one end of the cylinders, and including electric motors located at the other end of the cylinders and connected to respective shafts of the cylinders via threaded spindles supported in ball bearings and extending through threaded bores formed in a bridge, and means for controlling said electric motors for adjusting the circumferential and the lateral register of the cylinders separately from one another.

5. Register adjustment device according to claim 1, wherein the plate cylinder is disposed in mutually parallel engagement with a blanket cylinder, all of said gears being located at one end of the cylinders, and including electric motors located at the other end of the cylinders and connected to respective shafts of the cylinders via threaded spindles supported in ball bearings and extending through threaded bores formed in a bridge, and means for controlling said electric motors for adjusting the circumferential and the lateral register of the cylinders simultaneously.

6. Register adjustment device according to claim 1, wherein the plate cylinder is disposed in mutual parallel engagement with a blanket cylinder, both of the cylinders being mounted on respective parallel shafts, said further gear being fastened to the shaft of the plate cylinder and said double gear being fastened to the shaft of the blanket cylinder, and said drive gear being fastened to a shaft whereon an impression cylinder of the printing machine is mounted.

* * * * *